US006131518A

United States Patent [19]

Hains

[11] Patent Number: 6,131,518

[45] Date of Patent: Oct. 17, 2000

[54] SYSTEM FOR ENHANCING TARGET DAMAGE BY WATER JET IMPACT

[75] Inventor: Franklin D. Hains, Falls Church, Va.

[73] Assignee: The United States of America as represented by the Secretary of the Navy, Washington, D.C.

[21] Appl. No.: 09/168,849

[22] Filed: Oct. 9, 1998

Related U.S. Application Data

[63] Continuation-in-part of application No. 08/606,626, Feb. 26, 1996, abandoned.

[51] Int. Cl.[7] ..... F42B 22/00

[52] U.S. Cl. ..... 102/406; 102/305; 102/475; 102/701

[58] Field of Search ..... 102/305, 306, 102/406, 475, 476, 701

[56] References Cited

U.S. PATENT DOCUMENTS

| | | | |
|---|---|---|---|
| 2,768,072 | 10/1956 | Stark | 52/5 |
| 3,109,373 | 11/1963 | Saffer, Jr. | 102/399 |
| 3,360,070 | 12/1967 | Cholet et al. | 181/116 |
| 3,474,732 | 10/1969 | Thomison | 149/14 |
| 3,611,932 | 10/1971 | Clator | 102/305 |
| 3,714,897 | 2/1973 | Parker | 102/492 |
| 3,796,158 | 3/1974 | Conger | 102/492 |
| 3,897,728 | 8/1975 | Sternberg et al. | 102/406 |
| 3,961,594 | 6/1976 | Meyers | 114/222 |
| 3,995,574 | 12/1976 | Drimmer | 114/20.1 |
| 4,188,884 | 2/1980 | White et al. | 114/20.1 |
| 4,337,703 | 7/1982 | Schoner | 102/406 |
| 4,744,300 | 5/1988 | Bugiel | 102/291 |
| 5,078,069 | 1/1992 | August et al. | 114/20.1 |
| 5,320,043 | 6/1994 | Andre et al. | 102/291 |
| 5,450,794 | 9/1995 | Drimmer | 102/309 |
| 5,831,206 | 11/1998 | Cooper | 114/20.1 |

OTHER PUBLICATIONS

"Effect of Temperature Structure on the Initial Acceleration of a Spherical Thermal"; *The Physics of Fluids;* vol. 18, No. 9, Sep. 1975.

*Primary Examiner*—Harold J. Tudor
*Attorney, Agent, or Firm*—John Forrest; Jacob Shuster

[57] ABSTRACT

Different compositions of layers forming a non-homogeneous explosive charge are selected so as to produce in response to underwater detonation of such explosive charge a gas bubble having a corresponding internal density distribution of explosion products to predetermine shape and direction of a water jet emerging from such bubble during collapse thereof for enhanced impact damage to an adjacent underwater target.

5 Claims, 4 Drawing Sheets

SYSTEM FOR ENHANCING TARGET DAMAGE BY WATER JET IMPACT

The invention covered in the present application as a continuation-in-part of prior application Ser. No. 08/606,626 filed Feb. 26, 1996 now abandoned, relates generally to use of explosive charges for applying water jet impact damage to underwater targets.

BACKGROUND OF THE INVENTION

The detonation of a conventional explosive charge within a body of water produces an expanding gas bubble which eventually reaches a maximum diameter and begins to collapse. In open water, a bubble so formed will upon collapse have a spherical shape, oscillate a few times and eventually rise to the water surface. If such bubble is formed just beneath a submerged target, upon collapse it is no longer spherical as it rises upwardly and inverts to internally form a water jet impacting on the bottom of the target. Conventional explosives may be utilized to produce gas bubbles for such bottom-up target attack, but are not generally effective for side-on or top-down attacks because horizontal and downward moving jets are difficult to generate as a result of target attraction alone.

Heretofore, explosive generation of water jets as target warheads involved gas bubbles having internal mass density that was uniform throughout. As a result, the flow field of the gas within the bubble during its collapse was irrotational. Improvements in jet induced target damage therefore focused on the composition of a homogeneous explosive so as to maximize bubble size.

According to published research papers of the inventor, the collapse of a spherical shaped bubble so as to form an upward moving jet is possible even without the presence of a target if motion internally of the bubble is accelerated by a rotational flow field within the bubble upon reaching maximum size. Such rotational flow within the bubble gas was shown to result from a non-homogeneous gas density distribution that is spherically symmetric, characterized by a minimum density at the center of the bubble which increases along a parabolic curve to a maximum value at the outer bubble surface.

As to the formation of non-homogeneous explosive charges by different layer material compositions, U.S. Pat. Nos. 3,474,732 and 3,897,728 to Thomison and Stemberg et al. are of interest. However, the foregoing patents do not relate to bubble collapsing water jets or conditions affecting generation of such water jets. The Thomison patent relates instead to ignition of a massive magnesium structure by the layered explosive, while the Sternberg et al. patent relates to differential detonation of a layered explosive to enhance damage to an underwater target by shock waves.

It is therefore an important object of the present invention to enhance underwater target damage by impact of waterjets emerging from collapsing gas bubbles produced by detonation of non-homogeneous explosive charges.

It is an additional object of the invention to modify distribution of explosion product density within a bubble formed underwater by explosive charge detonation, so as to maximize target damage by the water jet resulting from bubble collapse upon reaching its maximum size.

SUMMARY OF THE INVENTION

Pursuant to the present invention, the shape and direction of a water jet emerging from a collapsing gas bubble is effected by selection of explosive charge layer material composition to maximize impact damage of an underwater target. While the use of different material compositions for concentric layers of a non-homogeneous explosive charge is per se already known in the art, according to the present invention explosive generation of a gas bubble undergoes a first phase of detonation and bubble expansion to a maximum size, followed by a second phase of bubble collapse and jet formation terminated by jet impact of the target. During the first phase, bubble gas density distribution follows a parabolic curve corresponding to the variation in thickness of the layers of the non-homogeneous explosive charge selected to maximize the bubble diameter at bubble collapse, as well to produce rotational flow of the gas. The resulting rise in gas jet velocity during the second phase is increased, as compared to jets heretofore produced by irrotational gas vorticity resulting from homogeneous bubble gas density distribution.

Thus, modification of explosion product density within a bubble upon collapse is coordinated for use in the different target impact scenarios such as bottom-up, side-on and top-down water jet attacks. Additionally, water jet speed is increased to maximize target damage.

The desired density distribution of explosive gas products within the bubble at its maximum size is achieved pursuant to the present invention by selection of layered arrangement for the non-homogeneous explosive charge and other explosive charge arrangements including controlled detonation timing.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
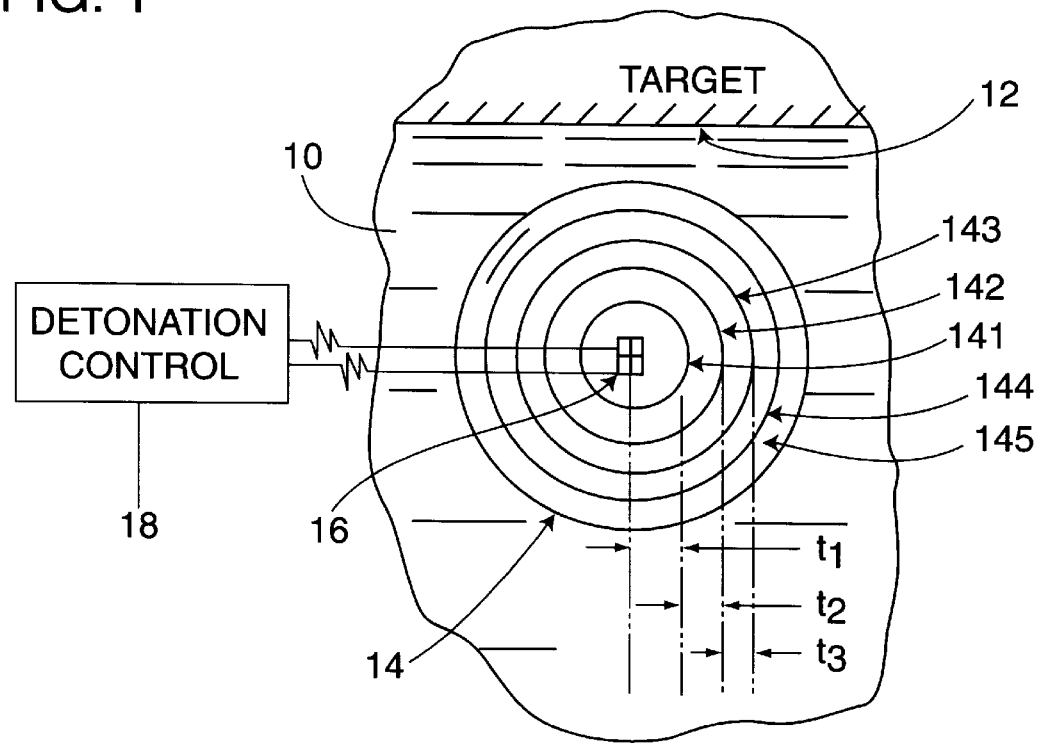
FIG. 1 is a partial schematic section view through a body of water within which an underwater target surface is shown in spaced adjacency to a non-homogeneous explosive charge, formed in accordance with one embodiment of the invention.
Figure 2:
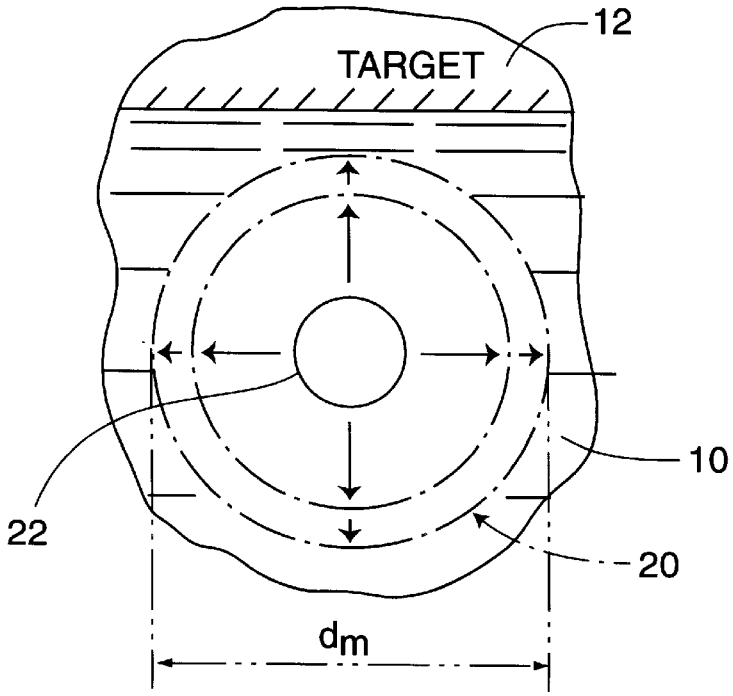
FIG. 2 is a partial schematic view corresponding to that of FIG. 1, diagramming an expanding gas bubble generated by detonation of the explosive charge.
Figure 3:
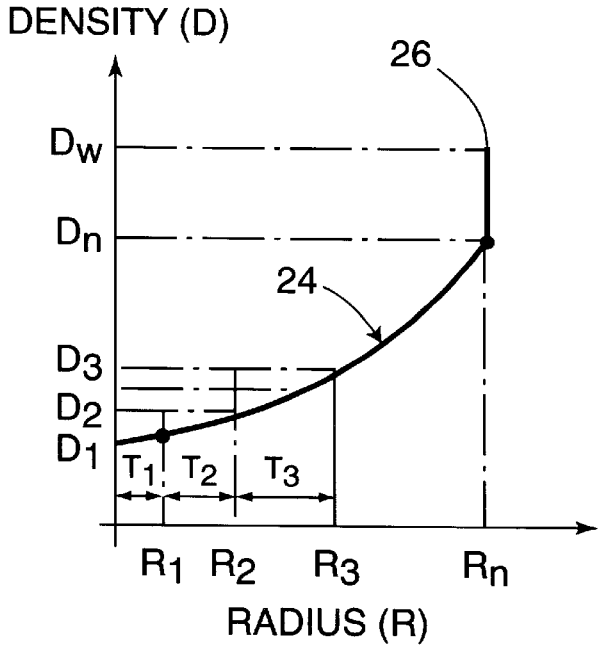
FIG. 3 is a graphical representation of gas density distribution within the expanding bubble shown in FIG. 2 upon expansion to its maximum size.

Referring now to the drawing in detail, FIG. 1 shows a body of water 10 within which a target 12 is located. Also located within such body of water 10 adjacent to the target 12 is an explosive charge 14 having a detonator 16 at its central core to which some remote detonation control 18 is connected as diagrammed in FIG. 1. The explosive charge 14 is composed of a non-homogeneous arrangement that is spherically symmetric in the illustrated embodiment, including a central layer section $\mathbf{14}_1$ of radius $t_1$, and a plurality of additional concentric layer sections $\mathbf{14}_2$, $\mathbf{14}_3$, $\mathbf{14}_4$, and $\mathbf{14}_5$ of thicknesses $t_2$, $t_3$, $t_4$ and $t_5$. The five layer sections as shown in FIG. 1 are made from different compositions so as to produce explosion products of correspondingly different densities upon detonation of the charge 14 to generate an expanding gas bubble 20 as diagrammed in FIG. 2. The bubble 20 so generated in response to detonation of the explosive charge 14 expands from the initial diameter 22 at the location of the charge 14 to a maximum diameter (dm) at which the bubble collapses in spaced adjacency to the target 12. Thus, the gas density (Dn) of the outer layered portion of the bubble of radius (Rn) is less than the water density (Dw) at a point 26 on the bubble surface at which the bubble collapses under water pressure.

Figure 4:
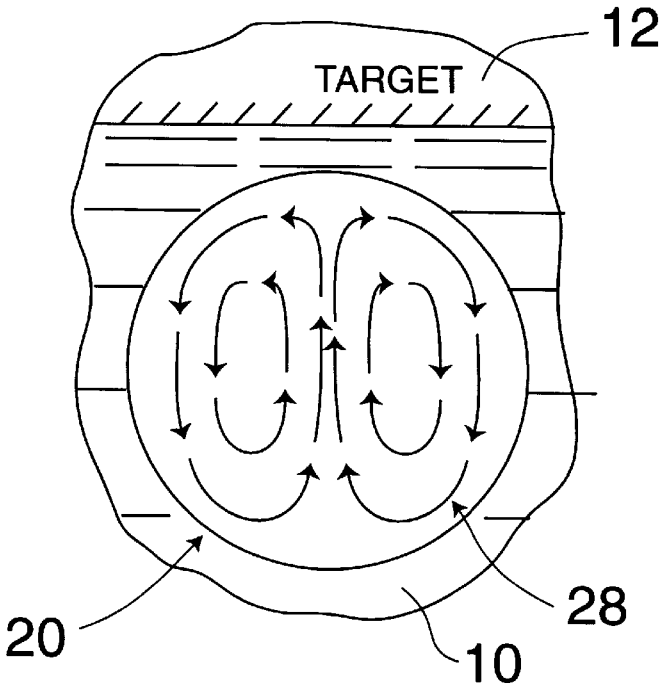
FIG. 4 is a partial schematic view of the rotational flow field within the expanding bubble diagrammed in FIG. 2 having the gas density distribution depicted in FIG. 3.
Figure 5:
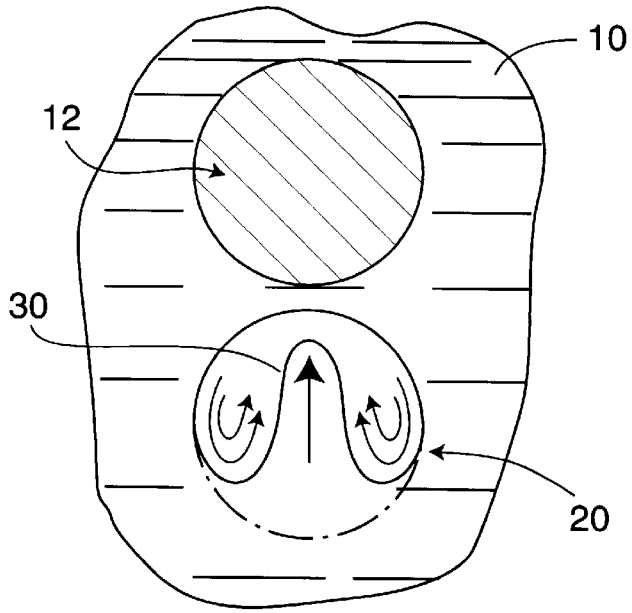
FIG. 5 is a partial schematic side section view through a body of water showing the underwater target and a collapsing gas bubble from which a target impact water jet is emerging.

In view of the foregoing gas density distribution within the expanding bubble 20 just prior to collapse, a rotational type of vortex flow of explosion products is induced as denoted by reference numeral 28 in FIG. 4. As a result of such rotational flow pattern within the bubble 20, upon collapse thereof a jet of water is produced as denoted by reference numeral 30 in FIG. 5. It will therefore be appreciated that the shape and travel direction of such water jet 30 will be determined by the aforementioned selection of the layered composition of the explosive charge 14 designed to generate the bubble 14. One or more charges 14 may accordingly be positioned underwater and detonated in spaced relation to the target 12 for a bottom-up attack, as shown in FIG. 5, to obtain maximized impact damage of the target.

Figure 6:
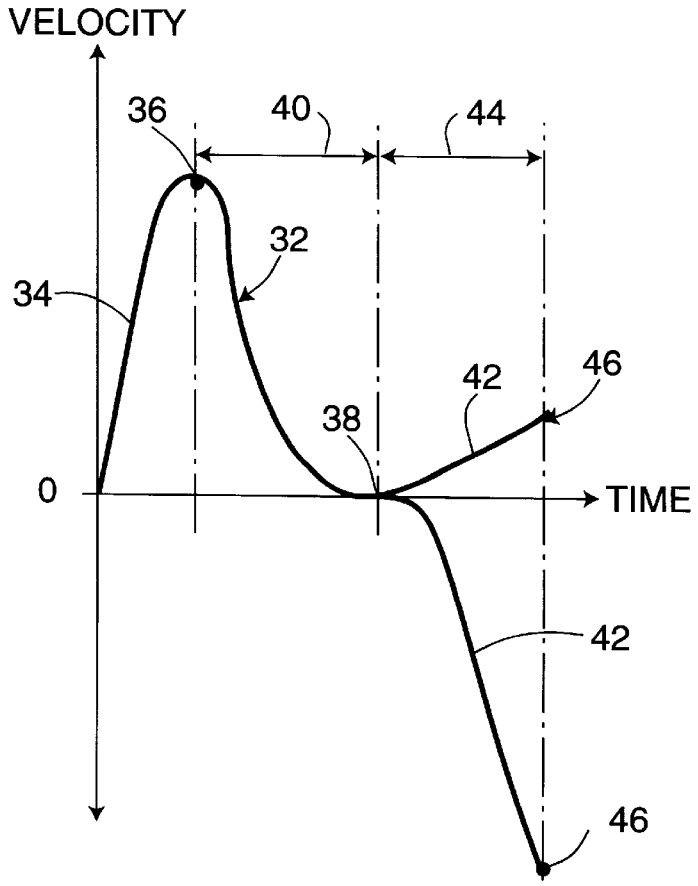
FIG. 6 is a graphical representation of the velocity history of the jet nose forming within the bubble depicted in FIGS. 2, 4 and 5.

FIG. 6 graphically diagrams variation with time of the velocity of the bubble gas which is in contact with the nose of the water jet, from its beginning to the point of target impact, in terms of a curve 32. As shown in FIG. 6, the curve 32 includes a sharply rising portion 34 reflecting the increase in gas velocity at the edge of the bubble 20 during its formation by detonation of the charge 14. The gas velocity then decreases from its peak value 36 to zero at point 38 during a bubble expansion phase 40 to its maximum diameter. The bubble gas velocity then increases in the direction of the target along portion 42 of the curve 32 during a bubble collapse and jet formation phase 44, terminated by target impact at point 46.

Figure 7:
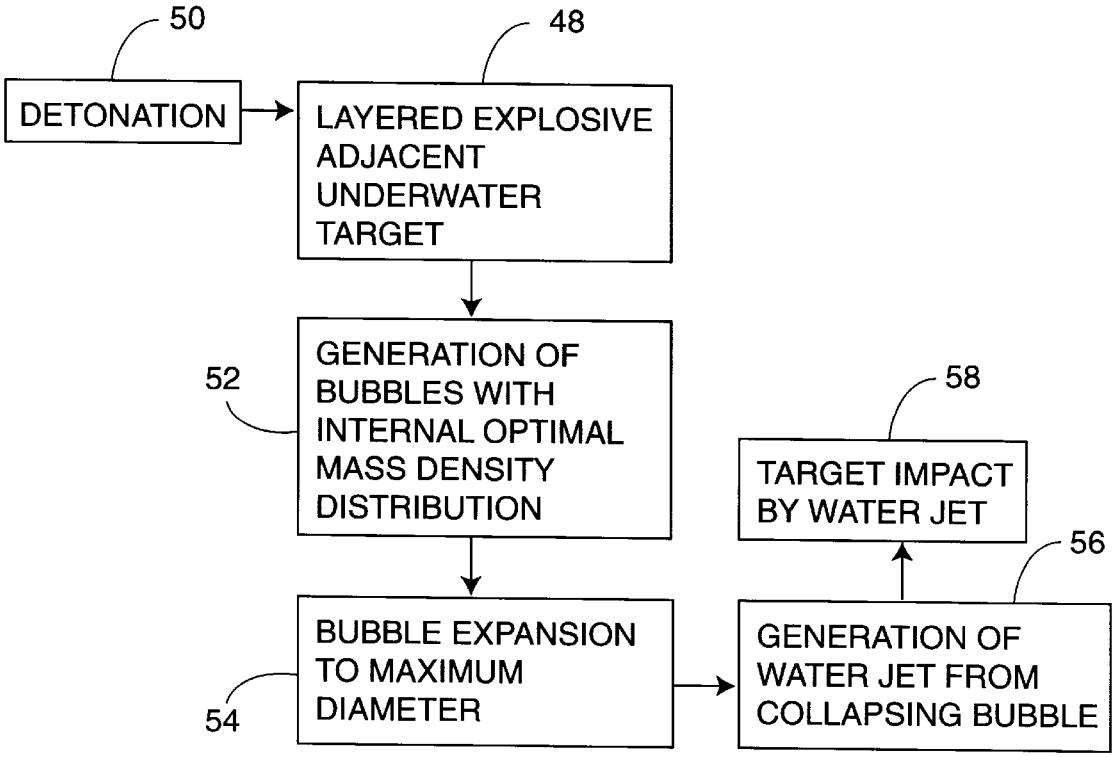
FIG. 7 is a block diagram summarizing the process associated with gas bubble generation and target impact as depicted in FIGS. 1–6.

The process for enhanced impact damage to the target as hereinbefore described is summarized by reference to the block diagram of FIG. 7, wherein block 48 denotes a layered explosive located adjacent the underwater target. Such explosive is detonated, as denoted by block 50, for generation of an underwater bubble having an internal explosion product density distribution, as denoted by block 52, optimized by a selected arrangement of layer compositions for the detonated explosive charge. The internal density distribution so obtained within the bubble produces a rotational vortex flow pattern as the bubble expands to a maximum diameter denoted by block 54. Upon collapse of the bubble after achieving expansion to its maximized diameter, a water jet emerges as denoted by block 56. Collapse of the bubble is completed by impact of the water jet with the target as denoted by block 58 in FIG. 7.

As hereinbefore described, the internal vorticity of the explosion products within the bubble 20 directionally controls motion of all gas particles so that one portion of the bubble surface is sucked in as the emerging water jet rapidly moves onto the target 12. The density distribution of the explosion products at maximum bubble size is therefore designed to be a function of the water jet velocity and gravity parallel to direction of the water jet 30 as depicted in FIG. 5. In the case of the bottom-up target attack depicted in FIG. 5, as well as a top-down attack of the water jet in the opposite direction, a density distribution that is spherically symmetric is utilized for the explosion products within the bubble. Where a side on or angle-attack scenario is desired, the water-jet direction is made transverse to the direction of gravity. In the latter case, the internal density distribution within the bubble cannot be spherically symmetric. A corresponding non-spherical layer arrangement for the explosive charge would then be selected for detonation at its center. Alternatively, detonation is effected at several spaced locations at the same time, or at slightly different times.

In accordance with the embodiment of the invention was hereinbefore described with respect to FIG. 1, a 2000 pound spherical TNT explosive charge 14 by way of example was modified to produce the underwater gas bubble 20, with a diameter (dm) of 26 feet, which collapsed and form an upward jet moving along a vertical axis toward the target 12. Such sperical charge 14 a 23 inch radius and divided into five layers, had layer thicknesses (in inches) of t1=5.0, t2=4.8, t3=4.6, t4=4.4, and t5=4.2. The composition of the first central layer $\mathbf{14}_1$ is pure TNT without any added material. The compositions of the remaining layers $\mathbf{14}_2$, $\mathbf{14}_3$, $\mathbf{14}_4$ and $\mathbf{14}_5$ are admixtures of TNT and an increasing amounts of powdered metal, such as copper or lead, to increase the mass density of each layer. Because a vertical jet is involved, the density in each layer is fixed and does not vary in the vertical direction. To achieve a parabolic mass density distribution across layers, the density (lb/cu ft) for the various layers are D1=101, D2=104, D3=113, D4=126, and D5=143.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an explosive charge formed by layers of material from a group exhibiting explosive characteristics which produce explosion products in response to underwater detonation of the explosive charge to generate a bubble undergoing expansion as a result of varying density distribution of the explosion products therein; a method of enhancing damage to an underwater target upon collapse of the bubble, including the steps of: selecting a non-homogeneous arrangement of the layers from said group exhibiting those of the explosive characteristics which induce rotational flow of the explosion products within the bubble resulting in emergency of a jet of water from said bubble upon said collapse thereof when expanding to a maximum size; and effecting said underwater detonation at a location to obtain said collapse of the bubble is space adjacency to the target enabling said emergence of the jet of water from the bubble for underwater travel to an impact with the target.

2. For use in a system to enhance damage of an underwater target in response to impact by a jet of water produced upon collapse of a bubble of gas generated by detonation of an explosive charge, the improvement residing in: selecting a non-homogeneous arrangement for the explosive charge formed by layer sections of different thicknesses and compositions corresponding to the formation of a gradient of gas density within the expanding bubble following said detonation of the explosive charge to induce rotational flow within the bubble as a result of a density distribution of explosion products therein obtained by said detonation and predetermine shape and travel direction of the jet of water emerging from said bubble upon said collapse thereof when expanding to a maximum size in spaced adjacency to the target.

3. For use in a system to enhance damage of an underwater target by impact with a jet of water during underwater travel produced in response to collapse of a bubble of gas generated by detonation of an explosive charge, the improvement residing in: selecting a non-homogeneous arrangement for the explosive charge formed by layer sections of different thicknesses and compositions corresponding to a gradient of increasing gas density within the bubble during expansion following said detonation of the explosive charge to obtain as a result of said detonation a density distribution of explosion products within the bubble inducing rotational flow therein prior to said collapses of the bubble.

4. For use in a system to enhance damage of an underwater target by impact with a jet of water produced in response to collapse of a bubble of gas generated by detonation of an explosive charge, the improvement residing in: electing a non-homogeneous arrangement for the explosive charge formed by layer sections of different thicknesses and compositions corresponding to a gradient of increasing gas density within the bubble during expansion following said detonation of the explosive charge to obtain as a result of said detonation a density distribution of explosion products within the bubble inducing rotational flow therein prior to said collapse of the bubble, the thickness of said layer sections decreasing radially outwardly from a central first one of said layer sections, the composition of which is pure TNT with the composition of the other layer sections including powdered metal admixed with the TNT to increase mass density of the other layer sections radially outward of the first one of the layer sections.

5. For use in a system to enhance damage of an underwater target by impact with a jet of water produced in response to collapse of a bubble of gas generated by detonation of an explosive charge, the improvement residing in: selecting a non-homogeneous arrangement for the explosive charge to induce rotational flow within the bubble prior to said collapse thereof as a result of a density distribution of explosion products within the bubble obtained by said detonation effected at a single point by spherical symmetry of the explosive charge relative thereto to obtain a vertical travel direction and predetermine shape of the water jet emerging from said bubble upon said collapse thereof upon expansion to a maximum size in spaced adjacency to the target.

* * * * *